US007540674B2

(12) United States Patent
Starkey

(10) Patent No.: US 7,540,674 B2
(45) Date of Patent: Jun. 2, 2009

(54) METHOD OF PRINTING INCLUDING MOVING A PRINT HEAD TO A DOWNSTREAM EXTREME POSITION

(75) Inventor: Simon Starkey, Leicatershire (GB)

(73) Assignee: Markem Technologies Limited (GB)

( * ) Notice: Subject to any disclaimer, the term of this patent is extended or adjusted under 35 U.S.C. 154(b) by 608 days.

(21) Appl. No.: 11/278,858

(22) Filed: Apr. 6, 2006

(65) Prior Publication Data

US 2006/0227165 A1 Oct. 12, 2006

(30) Foreign Application Priority Data

Apr. 6, 2005 (GB) ..... 0506942.2

(51) Int. Cl.
*B41J 2/32* (2006.01)
*B41J 11/42* (2006.01)

(52) U.S. Cl. ..... 400/120.01; 400/568; 400/578

(58) Field of Classification Search ..... 400/120.01
See application file for complete search history.

(56) References Cited

U.S. PATENT DOCUMENTS 5,795,084 A * 8/1998 Harding et al. ..... 400/225
5,846,002 A * 12/1998 Buckby et al. ..... 400/120.01
5,921,689 A * 7/1999 Buckby et al. ..... 400/225
5,971,634 A * 10/1999 Buckby et al. ..... 400/120.01
6,247,859 B1 * 6/2001 Butcher ..... 400/120.01
7,150,572 B2 * 12/2006 McNestry et al. ..... 400/223
2002/0154932 A1 * 10/2002 Jorgensen et al. ..... 400/120.01

FOREIGN PATENT DOCUMENTS

GB 2 302 523 1/1997
JP 2001-239685 9/2001

* cited by examiner

*Primary Examiner*—Daniel J Colilla
(74) *Attorney, Agent, or Firm*—Fish & Richardson P.C.

(57) ABSTRACT

A method of printing utilizing a printing apparatus having a base, a printing station where a print head is mounted, the print head including a plurality of printing elements which are selectively energisable to generate an image on a substrate upon there being relative movement between the substrate and the print head, the print head being moveable relative to the base, and the apparatus including a sensor device to sense the speed of the substrate as the substrate moves relative to the base adjacent to the printing station, and a controller to receive input signals from the sensor device and to control print head movement relative to the base to achieve a desired relative speed between the print head and the substrate, and wherein the method includes predicting when the speed of the substrate relative to the base, as the substrate advances, will be less than a predetermined speed, and in response, moving the print head at the printing station to a downstream extreme position of print head travel, and during printing of an image, moving the print head from the downstream extreme position towards the upstream extreme position.

9 Claims, 1 Drawing Sheet

METHOD OF PRINTING INCLUDING MOVING A PRINT HEAD TO A DOWNSTREAM EXTREME POSITION

RELATED APPLICATION

Under 35 U.S.C. § 119, this application claims the benefit of a foreign priority application filed in United Kingdom, serial number 0506942.2, filed Apr. 6, 2005.

BACKGROUND TO THE INVENTION

This invention relates to a method of printing, and more particularly but not exclusively to a method of thermal printing.

In a thermal printing apparatus, relative movement is required between a substrate and a print head whilst pixels of marking medium are removed from a ribbon, as printing elements of the thermal print head are selectively energised under computer control, to generate a desired image on the substrate.

In one known apparatus, the substrate is intermittently stationary at a printing station, whilst the print head is traversed along the substrate and the printing elements are selectively energised to generate the image. In another apparatus, the print head is held stationary at the printing station whilst the substrate is continuously advanced through the printing station, and the printing elements are selectively energised to generate the image.

DESCRIPTION OF THE PRIOR ART

In our previous patent application GB-A-2302523 there is described a method of printing and a printing apparatus for performing the method, in which, in the event the speed of printing is restricted by the operational speed of the print head such that the print head is unable to generate the desired image on a continuously advancing substrate, the print head may be moved relative to the advancing substrate in the direction in which the substrate is advancing to reduce the relative speed between print head and substrate, to give the print head more time to generate the image. This prior application also suggests that the speed at which the print head is moved may be adjusted depending on the speed of advancement of the substrate through the printing station.

Such an apparatus may be used where the substrate is intermittently stationary at the print station too, as the necessary relative movement between the print head and substrate whilst the printing elements are selectively energised, can be achieved by moving the print head in the direction in which the substrate is advanced.

In previous patent application JP-A-2001239685 there is disclosed a similar arrangement to GB-A-2302523 but in which the print head may be moved at the printing station, in the same or opposite direction to the substrate, depending on sensed substrate speed, to achieve a desired relative speed between the print head and substrate. After a printing operation, the print head is returned to a parked position between upstream and downstream permitted extremes of print head travel.

SUMMARY OF THE INVENTION

According to a first aspect of the invention we provide a method of printing utilising a printing apparatus having a base, a printing station where a print head is mounted, the print head including a plurality of printing elements which are selectively energisable to generate an image on a substrate upon there being relative movement between the substrate and the print head, the print head being moveable relative to the base, and the apparatus including a sensor device to sense the speed of the substrate as the substrate moves relative to the base adjacent to the printing station, and a controller to receive input signals from the sensor device and to control print head movement relative to the base to achieve a desired relative speed between the print head and the substrate, and wherein the method includes predicting when the speed of the substrate relative to the base, as the substrate advances, will be less than a predetermined speed, and in response, moving the print head at the printing station to a downstream extreme position of print head travel, and during printing of an image, moving the print head from the downstream extreme position towards the upstream extreme position.

Thus whereas the proposal in prior patent application JP-A-2001239685 permits the print head to be moved from the parked position towards the upstream extreme printing position to increase the relative speed between the print head and the substrate during printing, the length of the image which can be printed is limited by the distance between the parked and upstream extreme positions. By the method of the invention, where the substrate speed is predicted, by moving the print head to the downstream extreme position in advance of a printing operation, the entire distance between the upstream and downstream extreme positions of print head travel, may be utilised for printing, and thus longer images may be printed.

The method of the present invention lends itself to application on packaging lines for example, where the speed of advancement of the substrate may frequently change due to factors outside the control of the printing apparatus. In a usual mode of operation, the print head may be stationary at the printing station in the parked position, whilst the substrate is advanced at a speed, above the predetermined speed while the printing elements are selectively energised. However, in the event that the substrate is predicted to slow to below the predetermined speed relative to the base, which can seriously affect the image quality or even prevent a recognisable image being printed at all, the image may still be satisfactorily printed, by moving the print head at the printing station in a direction opposite to the direction of advancement of the substrate to increase relative print head-to-substrate speed, whilst continuing selectively to energise the printing elements, after having moved the print head to the downstream extreme position.

A prediction of substrate speed may be made from data input to the controller from a system to which the printing method is applied. For example, where the method is performed in a packaging system, downtime for replenishing packaging materials may be predictable, in which case the method may include predicting the slowing down or stoppage of a substrate at or approaching the printing station, and just prior to the predicted slowing down or stoppage of the substrate, moving the print head to the downstream extreme position. The method may include maintaining the print head at the printing station in a parked position intermediate the downstream extreme position of print head travel and an upstream extreme position of print head travel, and moving the print head to the downstream extreme position upon a slowing down or stopping of the substrate being predicted.

The method may include maintaining the print head stationary relative to the base at the printing station where the sensor device senses the speed of advancement of the substrate relative to the base is above the predetermined speed but below a maximum speed and predicting when the speed of the substrate relative to the base will be greater than the maximum speed, the method including in response, moving the print head at the printing station to the upstream extreme position, and during printing of an image, moving the print head in the direction of advancement of the substrate to reduce the relative print head to substrate speed.

The method of the invention may include, subsequently to printing an image in which the print head has been moved relative to the base, moving the print head at the printing station back to the parked position.

The method of the invention is particularly but not exclusively applicable to a method of thermal printing in which the printing elements are heated when energised, and a ribbon with marking medium is interposed between the substrate and print head during printing, such that the printing elements when energised, remove pixels of marking medium from the ribbon to generate the image.

The method may include moving the ribbon through the printing station in the direction of advancement of the substrate, at the same speed relative to the base as the sensed substrate speed, but to reduce ribbon usage, if desired the ribbon speed relative to the base through the printing station, may be less than the substrate speed. When the print head is moved at the printing station in a direction opposite to that of substrate advancement, the ribbon may be held stationary at the printing station during printing of an image, and advanced from the printing station subsequent to being used for printing. If desired, the ribbon may be held stationary at the printing station relative to the base, whilst more than one image is printed by utilising a different selection of printing elements of the print head for printing subsequent images.

The ribbon may be provided on a supply spool, and pass around a ribbon path through the printing station to a ribbon take-up spool. The ribbon may be moved around the ribbon path through the printing station by a capstan roller drive, a shuttle drive, or preferably by driving at least the take-up spool, and more desirably by driving both the supply and take-up spools, for example with one or both spools each being driven by a stepper motor. By controlling the motors, an appropriate ribbon tension for high resolution printing may be maintained in the ribbon during printing.

The method may include moving the print head towards the substrate prior to performing any printing operation, and away from the substrate after performing the printing operation.

Preferably moving of the print head from the parked position to the downstream extreme position is accomplished when the print head is moved away from any substrate and no printing elements are energised i.e. when no image printing is being performed.

The invention may be performed for printing on a substrate which is a continuous web, but may be performed on discrete substrates as required. The sensor device may be fixed relative to the base and may include one or a pair of rollers in contact with the moving substrate, preferably closely adjacent to the printing station, but any other desired sensor device, for example a sensor device which does not contact the substrate, may be used.

BRIEF DESCRIPTION OF THE DRAWINGS

Embodiments of the invention will now be described with reference to the accompanying drawing which is an illustrative side view of a printing apparatus for performing the method of the invention.

DETAILED DESCRIPTION OF THE PREFERRED EMBODIMENTS

Figure 1:
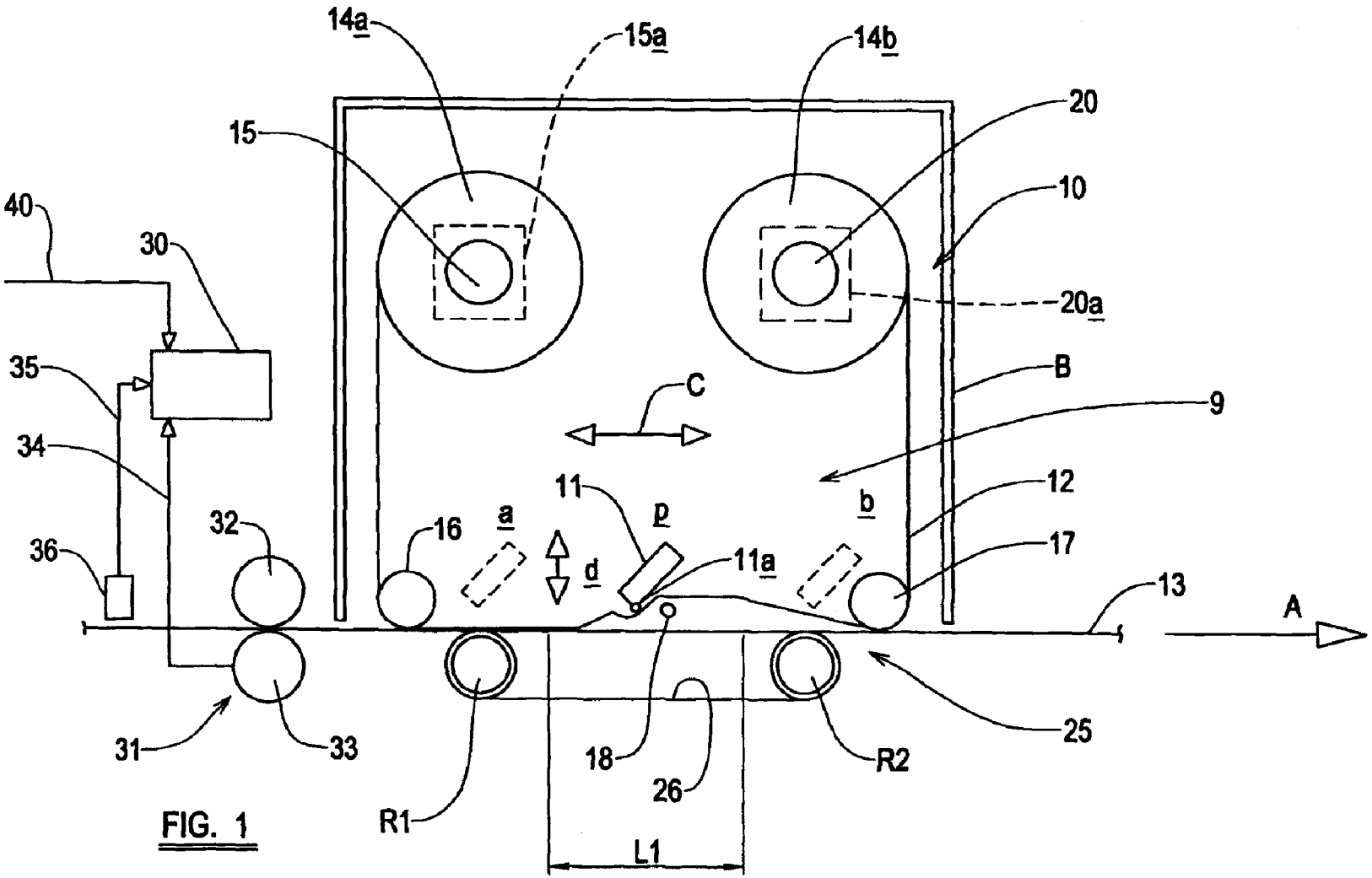

Referring to the drawing there is shown a printing apparatus 10 including a base B and a printing station 9, at which printing station 9 there is provided a print head 11 which has a plurality of individually energisable thermal printing elements, preferably provided in an array at an edge 11*a* of the print head 11. The print head 11 is movable relative to a ribbon 12 which carries print medium including ink, whilst the thermal printing elements of the print head 11 are individually selectively energised under computer control, wherein the elements will become hot thus to cause pixels of ink to be removed from the ribbon 12 and deposited onto a substrate 13 which in the arrangement shown in the drawings with the printing apparatus 10 in the orientation shown, is generally below the print head 11.

The substrate 13 is in this example a continuous flexible packaging web which is subsequently used to package an article or is applied to an article, but may be other packaging or labelling material, or may be an article itself. The substrate 13 is arranged by virtue of the packaging or other system in which the printing apparatus 10 is provided, to be moved in a direction of advancement A relative to the base B, towards and through the printing station 9 as hereinafter described, where one or more images are printed on the substrate 13 as the printing elements are selectively energised, and there is relative movement between the substrate 13 and the base B.

In this way information can be printed, in ink on the substrate 13.

The information usually is one or more alpha-numeric characters to indicate for example, a sell-by date. Alternatively, the information may be a bar-code or any other kind of coding as desired. The or each alpha-numeric character or bar-code or other image is defined by a plurality of pixels of print medium i.e. ink, transferred from the ribbon 12 by the energised printing elements of the print head 11 as the substrate 13 and the ribbon 12 relatively move.

The ribbon 12 carrying the ink is provided on a supply spool 14a carried on a hub 15 mounted on the base B, the ribbon 12 passing around a ribbon path including an idler roller 16, the printing station 9 where a peeler bar 18 is provided, and a further idler roller 17. The ribbon 12 is taken up on to a take-up spool 14b mounted on a hub 20 on the base B. The ribbon 12 may be moved around the ribbon path by means of a capstan drive roller arrangement (not shown), or a shuttle (not shown) or alternatively and preferably, at least the take-up spool 14*b* carried on hub 20 may be driven to drive the ribbon 12.

In a preferred arrangement, each of the supply spool hub 15 and the take-up spool hub 20, is driven by a respective motor 15*a*, 20*a*, each preferably being a stepper motor, and by controlling the respective motors 15*a*, 20*a* the tension of the ribbon 12, particularly at the printing station 9 may be controlled for optimal printing efficiency and resolution.

The print head 11 is mounted at the printing station 9 for movement relative to the ribbon 12 along the direction indicated by the double ended arrow C between two extreme positions of permitted travel indicated at a and b. The print head 11 may be mounted on a track or carriage for such movement and may be driven for movement relative to the ribbon 12 by a suitable motor via a transmission which may for example include rack and pinion arrangement, or one or more drive belts or the like.

In the FIGURE, the print head 11 is shown in a parked position p in-between the upstream and downstream extreme positions a, b of permitted travel of the print head 11 along direction C. As will be described below, the print head 11 may be operated to effect printing while stationary relative to the base B at the printing station 9, or whilst moving relative to the base B in either direction along direction C, between the extreme positions a, b, depending on the speed of the advancing substrate 13.

The print head 11 is also arranged to move towards and away from the substrate 13 by for example, a compressed air drive, or a mechanical arrangement as is well known in the art, as indicated by arrow d.

On the opposite side of the substrate 13 to the print head 11, there is provided a reaction surface 25 which in the present case includes a pair of rollers R1 and R2 around which is entrained a flexible belt 26. The rollers R1 and R2 are adapted to be rotated to cause the belt 26 to move with the substrate 13 during a printing operation as hereinafter described, such that there is no relative movement between the substrate 13 and the belt 26. In another arrangement, a reaction surface for the print head 11 may be provided by a single roller which moves with the print head 11, where the print head 11 moves during printing. In another example, a reaction surface may be provided by a discrete article which is conveyed to the printing station 9.

The ribbon 12 is located between the print head 11 and the substrate 13, and the print head 11, when moved towards the substrate 11 during printing i.e. as the printing elements are energised, urges the ribbon 12 into contact with the substrate 13 which in turn urges the substrate 13 towards and preferably into contact with the reaction surface 25 during a printing operation to promote removal of pixels of print medium from the ribbon 12. The peeler bar 18 is also provided for this purpose i.e. to promote the removal of pixels of print medium from the ribbon 12.

The apparatus 10 further includes a controller 30 to control the motors 15a, 20a for driving the spools 14a, 14b carried on the hubs 15 and 20 (and/or a capstan drive arrangement which may be provided), for controlling operation of the print head 11, and for controlling movement of the reaction surface 25. Movement of the substrate 13 is usually governed by the packaging or other system which advances the substrate 13 towards, through and from the printing station 9.

The substrate 13 advancing in direction A passes through a linear speed sensing device 31 of the apparatus 10, which in the present case includes a pair of rollers 32, 33 between which the substrate 13 passes prior to the substrate 13 moving through the printing station 9, past the print head 11. One of the rollers 33 of the sensing device 31 is linked to or includes a rotary encoder or another rotating motion sensor device, and is thus arranged to sense the speed of linear movement of the substrate 13 relative to the base B, and provide a suitable input signal along line 34 to the controller 30.

If desired a different kind of substrate speed sensor device may be employed, such as a device which does not contact the substrate 13. Such a speed sensing device may be an optical sensor device for example only, and may be provided where the substrate 13 is an article on which a image is to be printed rather than a continuous web.

Another input along line 35 to the control means 30 is from a sensor 36 which discriminates between subsequent areas of the substrate 13 onto which it is desired to print information.

An input 40 to the controller 30 is provided by a control signal from the packaging or other system and may indicate a predicted slowing down or stopping or speeding up of the advancing substrate or substrates 13, as explained below.

The controller 30 responds to the various inputs by causing the printing apparatus 10 to perform a printing operation the nature of which will depend upon the sensed speed of advancement of the substrate 13 and the predicted substrate 13 speed.

Assuming that the print head 11 is in the parked position p shown in the drawing, upon a "print" signal being received from sensor 36, the controller 30 calculates the linear speed of advancement of the substrate 13 in the feed direction A, relative to base B from the input signal from the encoder 31 or other sensor device.

In a usual mode of operation, the sensed substrate 13 speed will be below a maximum speed at which the print head 11 is capable of generating an image on the substrate 13 whilst the print head 11 remains stationary relative to the base B, and above a predetermined speed at which the print head 11 is capable of optimally printing a recognisable image on the substrate 13. It will be appreciated by those skilled in the art, that for optimum print quality, the thermal print head 11 has a preferred operating speed range, the print head 11 being incapable of printing an image faster than its maximum operating speed, and being incapable of generating a recognisable or high enough quality image if operated below its minimum operating speed.

Because the speed of the advancing substrate 13 is a function of the packaging system and not controlled by the printing apparatus 10, there is the possibility at least of the substrate 13 slowing or stopping altogether as the substrate 13 approaches, or whilst the substrate 13 is passing through, the printing station 9. Thus there is a risk that the substrate 13 will slow (or stop) to a speed at which the print head 11 would be required to print an image at a speed below its minimum operating speed.

In the event that the controller 30 receives an input from the sensor device 31 which indicates that a substrate 13, is advancing at a speed relative to the base B below the predetermined speed, the controller 30 moves the print head 11 during printing, relative to the base B, whilst selectively energising the printing elements to generate an image, in a direction opposite to the direction of advancement A of the substrate 13, thus to increase the relative speed between the substrate 13 and the print head 11, so that the print head 11 may be operated at above its minimum operating speed. It will be appreciated that the speed of movement of the print head 11 in the direction opposite to the direction of advancement A of the substrate 13, may be arranged to depend upon the speed of the advancing substrate 13. Thus in the event that the substrate 13 stops, the print head 11 may be moved faster in the direction opposite to substrate feed direction A, than if the substrate 13 merely slows.

Moreover, particularly where the substrate 13 is a continuous web, the sensor device 31 input to the controller 30 will indicate the actual speed of movement of the substrate 13 at the printing station 9, so even if slowing or stopping of the substrate 13 occurs during an image print, the controller 30 may respond by moving the print head 11 as described so that the image printing may be completed, relative movement between the print head 11 and substrate 13 being achieved in the case of the substrate 13 stopping at the print station 9, solely by the print head 11 movement.

During the usual print mode, when the print head 11 would be maintained stationary at the printing station 9 relative to the base B, immediately prior to printing, the print head 11 would be moved towards and into contact with the substrate 13, and the ribbon 12 is moved with the substrate 13, at the same speed or slightly slower than the substrate 13, so that fresh ribbon 12 is continuously presented to the print head 11. In-between printing operations, the print head 11 is moved away from the substrate 13, and the ribbon 12 may be held stationary as the printed upon substrate 13 is moved from the printing station 9 and before the next substrate or substrate part 13 is advanced to the printing station 9. However if desired, the ribbon 12 used in the previous printing operation could be at least partially rewound back though the printing station 9 in-between printing operations, and reused in a subsequent printing operation where the subsequent printing operation involves using a different selection of printing elements to the preceding printing operation, thus to remove remaining pixels of print medium from the ribbon 12 in the subsequent printing operation.

In a printing operation in which the print head 11 is moved relative to the base B in a direction opposite to the direction of advancement A of the substrate 13, the ribbon 12 may be again be moved at the same speed and in the same direction as the substrate 13, but if desired, to save ribbon 12, the ribbon 12 may be moved through the printing station 9 slower than the substrate 13, as fresh ribbon 12 will still be continuously presented to the print head 11 by virtue of the print head 11 movement. Where the substrate 13 is stopped and relative movement between the print head 11 and substrate 13 is accomplished solely by the movement of the print head 11 relative to the base B, the ribbon 12 is preferably held stationary at the printing station 9. In-between printing operations, the used ribbon 12 may be advanced towards the take-up spool 14*b,* or may be held stationary or at least partially rewound and reused for a subsequent printing operation, as desired. Also, in-between printing operations, the print head 11 may be returned to its parked position p, or may be moved back beyond the parked position p towards the downstream extreme position b, if the sensor device 31 senses that the next substrate 13 or substrate part 13 is advancing relative to the base B at a speed less than the predetermined speed such that movement of the print head 11 relative to the base B will be required for the next printing operation, to enable the print head 11 to operate at above its minimum operational speed.

In this way, for the next printing operation, the print head 11 will move towards the parked position p and perhaps beyond the parked position p, towards the upstream extreme position a.

In the event that the sensor device 31 senses that the speed of the advancing substrate 13 relative to the base B is too great for the print head 11 to print an image whilst stationary, even at its maximum operational speed, the print head 11 may be moved during printing in the feed direction A of the substrate 13, so as to reduce the relative speed between the substrate 13 and print head 11, from the parked position p towards the downstream extreme position b. At the end of the printing operation, the print head 11 may be moved back to the parked position p, in preparation for the next printing operation, or beyond towards the upstream extreme position a, if the sensor device 31 senses that the next substrate 13 or substrate part 13 is advancing at too great a speed.

During such printing operations in which the print head 11 is moved in the feed direction A, the ribbon 12 may be moved with the substrate 13.

In another arrangement, in a printing apparatus 10 where it is not expected that the speed of advancement of the substrate 13 relative to the base B will ever exceed the capability of the print head 11 to perform a printing operation, the print head 11 may be parked in-between printing operations at a position adjacent to the downstream extreme position b, in preparation for being moved in a direction opposite to the substrate 13 feed direction A in the event that the substrate 13 slows or stops. Thus the print head 11 would be able to be moved through the whole range of travel permitted by the track or other mounting at the printing station 9, whilst performing printing.

In the example of the drawing, the reaction surface 25 is moved to match the speed of the substrate 13 by a motive means driving one or both of the rollers R1 and R2, the reaction surface 25 being driven at the speed of the substrate 13 as sensed by substrate speed sensor device 31. Where the reaction surface 25 is provided by a single roller, this may be arranged to move in synchronism with any print head 11 movement.

It will be appreciated that when the printing apparatus 10 is operated in its usual operating mode, with the print head 11 stationary, there is effectively no restriction to the length of the image which can be printed. However, when the print head 11 is moved during a printing operation in a direction opposite to the direction of advancement A of the substrate 13 and the substrate 13 is stationary at the printing station 9, the length of the image which can be printed along the substrate 13 will be restricted to a maximum length, being the distance $L_1$ between the upstream and downstream extreme positions of travel a and b, but only if the print head movement 11 commences from the downstream extreme position b, but provided that there is some substrate 11 movement in the direction of advancement A, longer images may still be produced, the maximum length decreasing towards $L_1$ with decreasing substrate 13 speed.

In accordance with the invention, the print head 11 is usually at the parked position p intermediate the upstream and downstream extreme positions of print head 11 travel a, b, but where it is predicted that the substrate 13 will slow or stop at the printing station 9, from the system input 40 to the controller 30 of the printing apparatus 10, the controller 30 is arranged to move the print head 11 from the parked position p towards the downstream extreme position b in preparation for a forthcoming printing operation in which print head 11 movement relative to the base B is required to effect or complete an image printing operation, at the printing station 9.

Conversely, if it is predicted that the substrate 13 speed may be about to exceed the maximum speed at which the print head 11 can print, the controller 30 responds to moving the print head 11 to the upstream extreme position a for subsequent movement along the substrate 13 in the direction A of advancement of the substrate 13.

Various modifications in addition to those already indicated, may be made without departing from the scope of the invention.

For example, although the invention has been described with reference to a thermal printing apparatus 10 which utilises a ribbon 12 carrying marking medium which is deposited by heated thermal printing elements onto the substrate 13, the invention may be applied to any other printing apparatus 10 having a print head 11 which has energisable printing elements, which requires operation above a minimum operating speed for optimal and most efficient printing.

The packaging or other system to which the printing apparatus 10 is provided, may be able to provide input 40 to the controller 30 predicting a change in speed of the substrate 13 which would bring the substrate 13 speed outside the range of speed between the predetermined and maximum speeds, in response to a fault, or developing fault, upstream of the printing apparatus 10, or a, e.g. temporary, change in one or more manufacturing or environmental parameters.

It will be appreciated that should print head 11 be at one or other of the upstream and downstream extreme positions of print head 11 travel at the end of a print, and it is predicted that the substrate 13 speed for the next print may be outside the range of substrate speeds between the predetermined speed and the maximum speed, as appropriate, the controller 30 may act to move the print head 11 from the upstream or downstream extreme position of print head travel, to the other downstream or upstream extreme position of print head travel in preparation for the next print, without first parking the print head 11 at parking position p.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A method of printing utilising a printing apparatus having a base, a printing station where a print head is mounted, the print head including a plurality of printing elements which are selectively energisable to generate an image on a substrate upon there being relative movement between the substrate and the print head, the print head being moveable relative to the base, and the apparatus including a sensor device to sense the speed of the substrate as the substrate moves relative to the base adjacent to the printing station, and a controller to receive input signals from the sensor device and to control print head movement relative to the base to achieve a desired relative speed between the print head and the substrate, and wherein the method includes predicting when the speed of the substrate relative to the base, as the substrate advances, will be less than a predetermined speed, and in response, moving the print head at the printing station to a downstream extreme position of print head travel, and during printing of an image, moving the print head from the downstream extreme position towards an upstream extreme position of print head travel.

2. A method according to claim 1 wherein the print head is stationary at the printing station until the substrate is predicted to slow to below the predetermined speed relative to the base, when the print head is moved at the printing station in a direction opposite to the direction of advancement of the substrate to increase relative print head-to-substrate speed, whilst continuing selectively to energise the printing elements, after having moved the print head to the downstream extreme position.

3. A method according to claim 1 wherein a prediction of substrate speed is made from data input to the controller from a system to which the printing method is applied.

4. A method according to claim 1 which includes maintaining the print head at the printing station in a parked position intermediate the downstream extreme position of print head travel and an upstream extreme position of print head travel, and moving the print head to the downstream extreme position upon a slowing down or stopping of the substrate being predicted.

5. A method according to claim 1 which includes maintaining the print head stationary relative to the base at the printing station where the sensor device senses the speed of advancement of the substrate relative to the base is above the predetermined speed but below a maximum speed and predicting when the speed of the substrate relative to the base will be greater than the maximum speed, the method including in response, moving the print head at the printing station to the upstream extreme position, and during printing of an image, moving the print head in the direction of advancement of the substrate to reduce the relative print head to substrate speed.

6. A method according to claim 4 which includes subsequently to printing an image in which the print head has been moved relative to the base, moving the print head at the printing station back to the parked position.

7. A method according to claim 1 wherein the method is a method of thermal printing in which the printing elements are heated when energised, and a ribbon with marking medium is interposed between the substrate and print head during printing, such that the printing elements when energised, remove pixels of marking medium from the ribbon to generate the image.

8. A method according to claim 1 which includes moving the print head towards the substrate prior to performing any printing operation, and away from the substrate after performing the printing operation.

9. A method according to claim 8 which includes moving of the print head to the downstream extreme position is accomplished when the print head is moved away from any substrate and no printing elements are energised, when no image printing is being performed.

* * * * *